United States Patent [19]

Karp

[11] 4,367,118

[45] Jan. 4, 1983

[54] LABEL APPLICATOR

[75] Inventor: Edward C. Karp, Belvidere, Ill.

[73] Assignee: Sanitary Scale Co., Belvidere, Ill.

[21] Appl. No.: 310,220

[22] Filed: Oct. 9, 1981

[51] Int. Cl.[3] ..... B65C 9/14; B65C 9/36

[52] U.S. Cl. ..... 156/497; 156/541; 156/542; 156/569; 156/571; 156/DIG. 31; 156/DIG. 33; 156/DIG. 42

[58] Field of Search ..... 156/541, 542, 497, 569, 156/571, 570, 572, DIG. 31, DIG. 29, DIG. 33, DIG. 42

[56] References Cited

U.S. PATENT DOCUMENTS

| | | | |
|---|---|---|---|
| 2,294,273 | 8/1942 | Buxbaum | 156/DIG. 31 |
| 2,414,019 | 1/1947 | Carter | 156/569 |
| 2,712,393 | 7/1955 | Brown | 156/572 |
| 3,645,832 | 2/1972 | Sauer | 156/541 |
| 3,736,208 | 5/1973 | Kraft et al. | 156/541 |

*Primary Examiner*—Michael G. Wityshyn
*Attorney, Agent, or Firm*—Cook, Wetzel & Egan

[57] ABSTRACT

A label applicator is described for seizing a printed, adhesive backed label and for applying the label to a commodity. The applicator includes a pick-up head for vacuum-seizing a portion of the label by its non-adhesive side and for swinging the label to a label transfer station. At the latter station, the pick-up head releases its grip on the label and an applicator head vacuum-seizes another portion of the non-adhesive side of the label and then applies the label to the commodity.

5 Claims, 3 Drawing Figures

PICK-UP STATION
22
12
72

66
60
68
12
30
22
58
62
56
14
22
12
60
66
68
TRANSFER STATION

LABEL APPLICATOR

BACKGROUND OF THE INVENTION

This invention is directed to an improved label applicator for transferring printed labels from a label printer to a weighed commodity.

Scales such as those used in supermarkets are typically coupled to a printer for printing the weight, price and other characteristics of a weighed commodity on an adhesive coated label. The printed label is then placed on a weighed commodity by a label applicator.

Conventional label applicators include a vacuum-assisted pick-up arm or nozzle which grabs the label on its upwardly facing, adhesive coated side, rotates the label to turn the adhesive coated side down, and positions the label under a vacuum-assisted platen. The label is transferred from the pick-up arm to the platen, the pick-up arm pivots from the platen, and the platen descends to place the label, adhesive side down, on the previously weighed commodity.

One problem with such a label applicator is that both the adhesive side and the non-adhesive side of the label are handled. This adds complexity to the applicator in addition to allowing adhesive to accumulate on the pick-up arm, thereby decreasing the reliability of the label transfer function. In addition, the necessity of rotating the label from an adhesive side up position to an adhesive side down position requires a drive mechanism which is unduly complicated and expensive.

OBJECTS OF THE INVENTION

It is a general object of the invention to provide an improved label applicator for use with a scale and label printer.

It is a more specific object of the invention to provide a label applicator which handles only the non-adhesive side of labels, which does not require inversion of a label during its transfer from the printer to a weighed commodity, and which provides more reliable transfer of labels to weighed commodities.

BRIEF DESCRIPTION OF THE FIGURES

The objects stated above and other objects of the invention are set forth more particularly in the following detailed description of the accompanying drawings, of which.

DESCRIPTION OF THE PREFERRED EMBODIMENT

Figure 1:
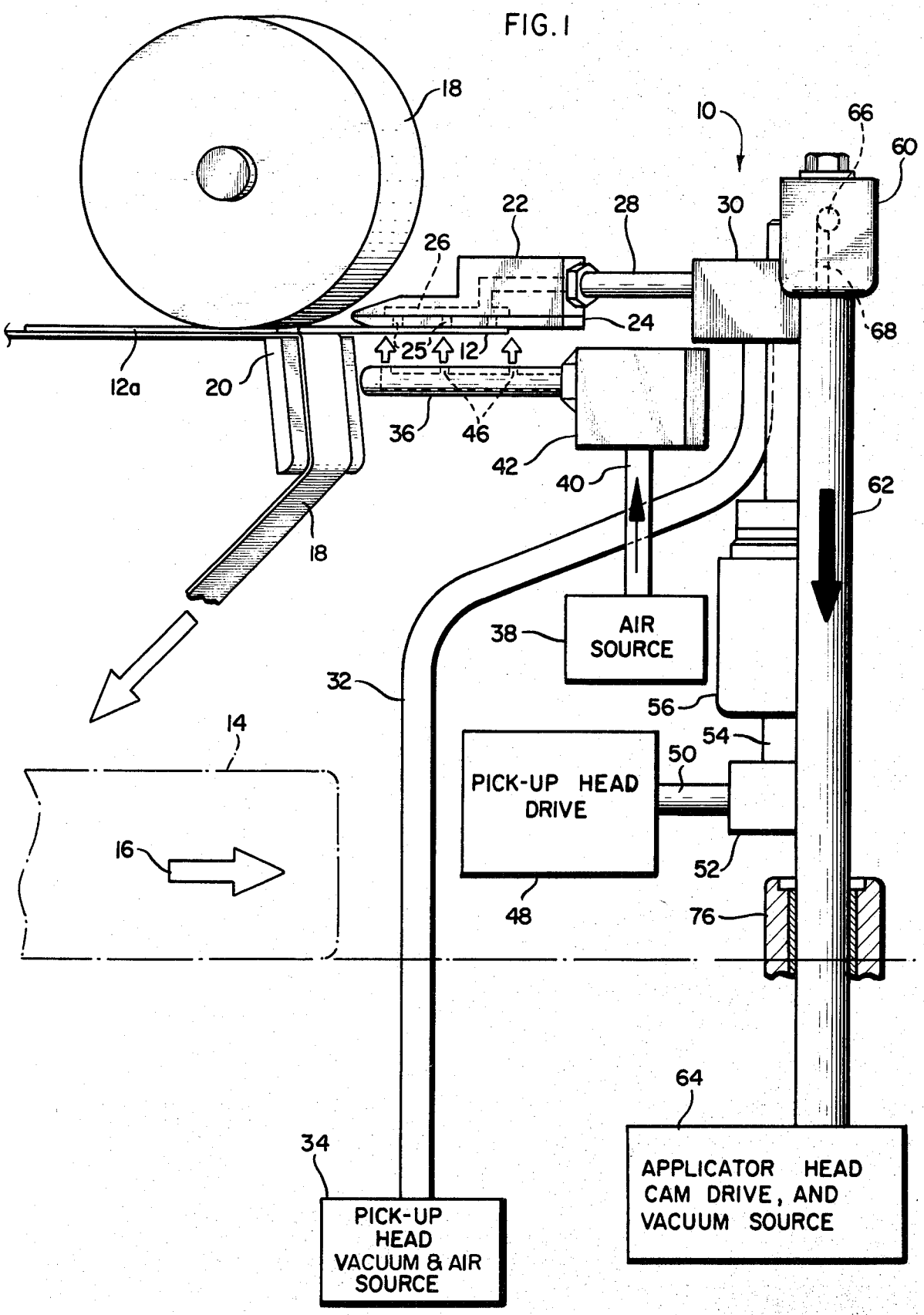
FIG. 1 is a partly schematic view of a label applicator according to the invention.

Referring to FIG. 1, the present label applicator is generally identified by reference numeral 10. This applicator is designed to receive labels 12 and **12*a* at a label pick-up station and to apply the received label to a weighed commodity 14. As indicated by the arrow 16, the commodity 14** is transported laterally by any conventional conveyor to a position at which it will receive a label.

Prior to being picked up by the applicator 10, the label 12 receives printed indicia from a conventional print drum 18. Typically, the indicia printed on the label includes the weight of the commodity, its price per pound, total price, and other characteristics of the weighed commodity.

As the label 12 is advanced past the print drum, the label's backing strip 18 is removed by a stripper bar 20 and fed to a take-up spool (not shown). The label itself is fed with its non-adhesive side (print side) up to a pick-up station. Located at this station is a vacuum-assisted pick-up head 22 for seizing the label 12 by its non-adhesive side. As shown, the head 22 includes a lower shoe 24 whose downwardly facing surface includes air holes 25. These holes communicate with a chamber 26, a hollow arm 28 which supports the pick-up head, a block 30 having an air conduit therein, and an air pipe 32 which is coupled to a vacuum source 34. Thus, a vacuum path is established between the source 34 and the shoe 24 for vacuum-seizing the label 12.

As the label 12 emerges from beneath the print drum 18, it will, initially, have little contact with the underside of the shoe. Therefore, a tube 36 directs a stream of air upwardly on the bottom side of the label 12 to air-drive it toward the pick-up head so as to assist in establishing full contact between the downwardly facing surface of the pick-up head and the portion of the label to be seized.

Air is supplied to the tube 36 via a conventional air source 38, a conduit 40, and a block 42 having an air path therein. Inside the arm 36, a chamber 44 communicates with air holes 46 for directing the air upwardly.

Having seized the label, the pick-up head is swung in a substantially horizontal plane through an angle of about 105 degrees by means of a drive mechanism 48, a shaft 50, a coupler 52, another shaft 54, and a conventional coupler and journal 56. The coupler and journal 56 rotates a further shaft 58 for rotating the block 30, arm 28 and the pick-up head through an angle of about 105 degrees to move the seized label to a label transfer station. At the latter station, the label is transferred to a vacuum-assisted applicator head 60.

A hollow shaft 62 couples the head 60 to a vacuum source and cam drive mechanism 64. the latter device operates to lower the head 60 for application of the label to the commodity 14 (which has been transported to a position beneath the applicator head) and to supply a vacuum to a chamber 66 and air hole 68 which communicate with the interior of the shaft 62. A journal 76 may be included to hold the shaft 62.

Figures 2, 3:
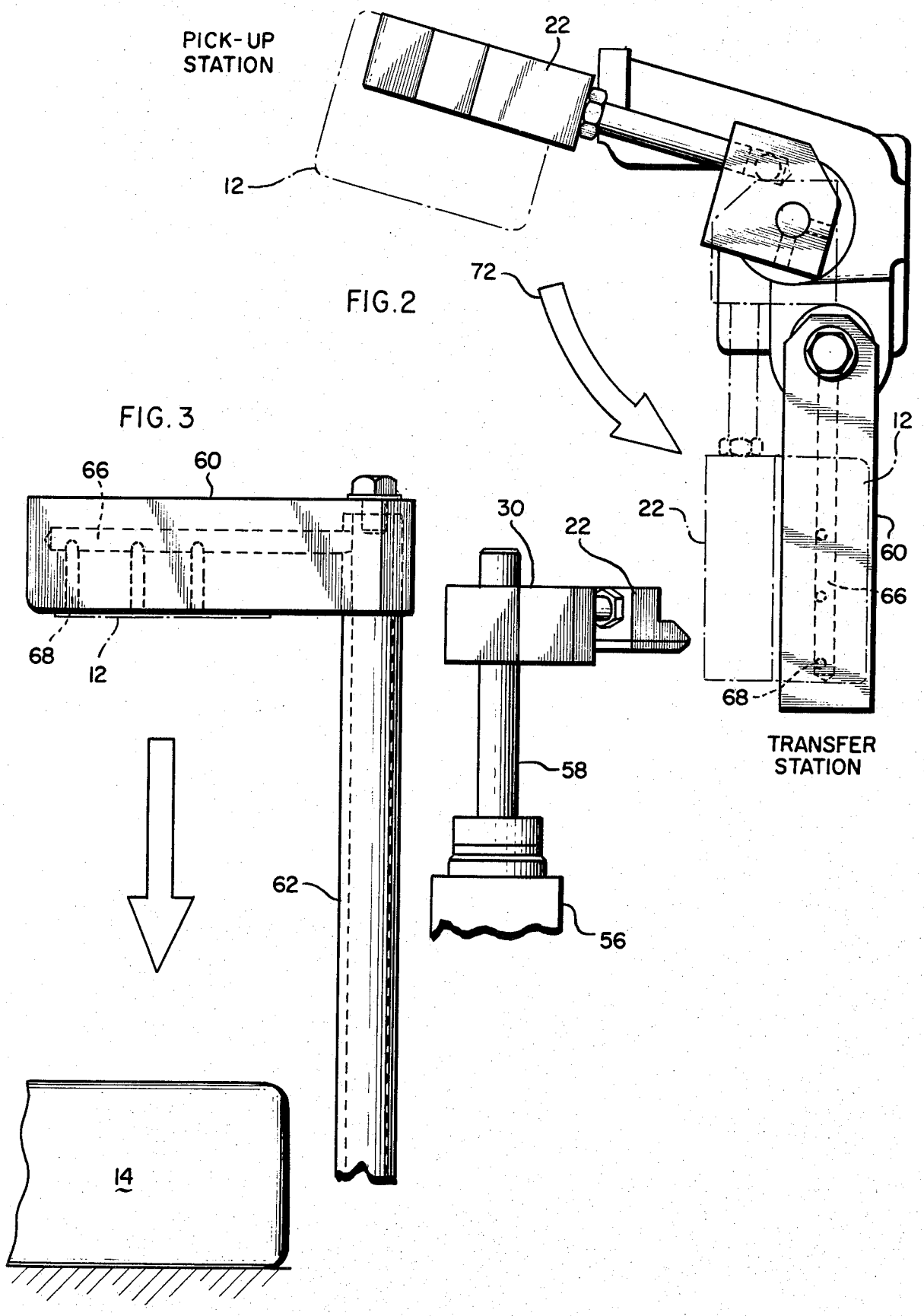
FIG. 2 is a top plan view of the pick-up head and applicator head shown in FIG. 1, including a phantom view of the pick-up head to illustrate its range of movement.
FIG. 3 is a side view of the pick-up head and applicator head showing the relationship of the applicator head to a commodity which is to receive a label.

The transfer of the label to the applicator head and thence to the commodity is best explained with reference to FIGS. 2 and 3. As shown in FIG. 2, the pick-up head 22 is positioned at the pick-up station so as to seize about one-half of the non-adhesive side of the label 12. The pick-up head is then swung as indicated by the arrow 72 to the transfer station. At this station, the pick-up head is shown in phantom.

At the transfer station, the applicator head is positioned above and closely adjacent the pick-up head 22 for vacuum-seizing the half of the label which extends beyond the pick-up head. Such transfer of the label is preferably effected by releasing the vacuum on the pick-up head while simultaneously drawing a vacuum on the applicator head. The label is thus seized by the applicator head.

After transferring the label 12 to the applicator head, the pick-up head swings back to the pick-up station.

The cam drive in box 64 (FIG. 1) then lowers the applicator head and the seized label to apply the adhesive side of the label 12 to the commodity 14. The vacuum in the applicator head is then released and the applicator head is raised to receive the next label from the pick-up head. This sequence continues in order to apply a label to each commodity which is presented.

Several of the ancillary components of the applicator have been shown schematically because they may be conventional. For example, the drive mechanisms for the pick-up head and the applicator head may be of any conventional type. The model 601 labeler made by Toledo Scale, for example, includes couplers and drive mechanisms which may be fit to the present label applicator.

As will be appreciated from the foregoing description, the present applicator has the advantage of not contacting the adhesive side of the label. Hence, no adhesive is accumulated on the components of the applicator and more reliable operation results. In addition, the label is not inverted during the transfer process. Hence, a less complicated applicator is provided.

Although the label applicator has been described in terms of a preferred embodiment, it will be obvious to those skilled in the art that many alterations and modifications may be made without departing from the invention. Accordingly, it is intended that all such modifications and alterations be considered as within the spirit and scope of the invention as defined by the appended claims.

What is claimed is:

1. A label applicator for transferring printed adhesive backed labels from a label pick-up station to a commodity comprising:

a vacuum-assisted pick-up head adapted to be positioned closely above the non-adhesive side of a label at the pick-up station so as to seize the label by its non-adhesive side such that a part of the label is held by the pick-up head and a second part of the label extends beyond the pick-up head, the pick-up head being further adapted to swing the label to a transfer station;

a vacuum-assisted applicator head positioned at the transfer station such that, when the pick-up head arrives at the transfer station, the applicator head is situated above and closely adjacent the pick-up head so as to vacuum-seize the second part of the label by its non-adhesive side, the applicator head being further adapted to move downwardly and apply the label to the commodity.

2. A label applicator as set forth in claim 1 wherein the pick-up head is positioned to seize a label such that about one-half the label extends beyond the pick-up head, and wherein the applicator head seizes the extending half of the label at the transfer station.

3. A label applicator as set forth in claim 2 wherein the pick-up head is adapted to release the label at the transfer station while a vacuum applied to the applicator head causes the label to be seized by the applicator head.

4. A label applicator as set forth in claim 3 wherein the pick-up head includes a downwardly facing surface containing apertures for vacuum-seizing a label, and further including means positioned at the pick-up station for air driving the label upwardly toward the pick-up head so as to assist in establishing full contact between the pick-up head's downwardly facing surface and the portion of the label to be seized.

5. A label applicator for transferring printed, adhesive-backed labels from a label pick-up station to a commodity, comprising:

a vacuum assisted pick-up head having a downwardly facing surface containing apertures for vacuum-seizing a label, said pick-up head being adapted to be positioned closely above the non-adhesive side of a label at the pick-up station so as to seize the label by its non-adhesive side such that about one-half of the label is held by the pick-up head and the other half of the label extends beyond the pick-up head, the pick-up head being further adapted to swing the label in a substantially horizontal plane to a label transfer station, and to then release the label for seizure by an applicator head;

means positioned at the pick-up station and beneath an incoming label for air driving the label upwardly toward the pick-up head so as to assist in establishing full contact between the pick-up head's downwarding facing surface and the portion of the label to be seized;

a vacuum-assisted applicator head positioned at the transfer station such that, when the pick-up head arrives at the transfer station, the applicator head is situated above and closely adjacent the pick-up head for vacuum-seizing the extending half of the label by its non-adhesive side, the applicator head being further adapted to move downwardly for applying the label to the commodity.

* * * * *